US005976355A

United States Patent [19]

Johnson et al.

[11] Patent Number: 5,976,355

[45] Date of Patent: Nov. 2, 1999

[54] LOW RESIDENCE TIME CATALYTIC CRACKING PROCESS

[75] Inventors: Axel R. Johnson, North Babylon, N.Y.; Robert J. Gartside, Wellesley, Mass.; Joseph L. Ross, Houston, Tex.; Dennis A. Duncan, Sharon, Mass.

[73] Assignee: Stone & Webster Engineering Corp., Boston, Mass.

[21] Appl. No.: 08/574,585

[22] Filed: Dec. 14, 1995

Related U.S. Application Data

[63] Continuation of application No. 08/271,239, Jul. 6, 1994, abandoned, which is a continuation of application No. 08/170,446, Dec. 20, 1993, abandoned, which is a continuation of application No. 08/043,622, Apr. 7, 1993, abandoned, which is a continuation of application No. 07/895,214, Jun. 8, 1992, abandoned, which is a continuation of application No. 07/774,364, Oct. 9, 1991, abandoned, which is a continuation of application No. 07/655,247, Feb. 13, 1991, abandoned, which is a continuation of application No. 07/548,199, Jul. 5, 1990, abandoned, which is a continuation of application No. 07/414,663, Sep. 29, 1989, abandoned, which is a continuation of application No. 07/201,379, May 31, 1988, abandoned, which is a continuation of application No. 06/587,936, Mar. 9, 1984, abandoned.

[51] Int. Cl.[6] ..... C10G 11/02

[52] U.S. Cl. ..... 208/119; 208/161

[58] Field of Search ..... 208/113, 153, 208/161, 101, 119, 163, 164

[56] References Cited

U.S. PATENT DOCUMENTS

| | | | |
|---|---|---|---|
| 2,848,381 | 8/1958 | Nicholson | 422/214 X |
| 3,617,497 | 11/1971 | Bryson et al. | 208/120 |
| 3,617,512 | 11/1971 | Bryson | 208/120 |
| 3,639,228 | 2/1972 | Carr et al. . | |
| 3,835,029 | 9/1974 | Larson | 208/113 |
| 4,299,687 | 11/1981 | Myers et al. . | |
| 4,318,800 | 3/1982 | Woebcke et al. | 208/127 |
| 4,331,533 | 5/1982 | Dean et al. | 228/113 |
| 4,376,038 | 3/1983 | Myers . | |
| 4,384,948 | 5/1983 | Barger . | |
| 4,385,985 | 5/1983 | Gross et al. | 208/113 |
| 4,417,974 | 11/1983 | Haunschild | 208/75 |
| 4,419,221 | 12/1983 | Castagnos, Jr.et al. | 208/113 |
| 4,497,638 | 2/1985 | Johnson et al. | 208/127 X |
| 4,515,683 | 5/1985 | Beck et al. . | |
| 4,541,922 | 9/1985 | Lomas et al. . | |
| 4,584,090 | 4/1986 | Farnsworth . | |
| 4,602,993 | 7/1986 | Myers . | |
| 4,675,099 | 6/1987 | Skraba . | |
| 4,784,748 | 11/1988 | Avidan . | |
| 4,814,087 | 3/1989 | Gartside et al. . | |
| 4,985,136 | 1/1991 | Bartholic . | |
| 5,296,131 | 3/1994 | Raterman . | |
| 5,462,652 | 10/1995 | Wegerer . | |
| 5,637,207 | 6/1997 | Hsing et al. . | |

*Primary Examiner*—George R. Fourson
*Attorney, Agent, or Firm*—Hedman, Gibson & Costigan, P.C.

[57] ABSTRACT

A process for producing liquid fuels from heavy hydrocarbons such as residual oil in which the cracking temperatures are in the range of 800° F. to 1200° F., and the residence times are between 0.05 seconds and 0.50 seconds.

18 Claims, 3 Drawing Sheets

LOW RESIDENCE TIME CATALYTIC CRACKING PROCESS

The present application is a continuation application of Ser. No. 08/271,239, filed Jul. 6, 1994, now abandoned, which in turn is a continuation application of Ser. No. 08/170,446, filed Dec. 20, 1993, now abandoned, which in turn is a continuation application of Ser. No. 08/043,622, filed Apr. 7, 1993, now abandoned, which in turn is a continuation application of Ser. No. 07/895,214, filed Jun. 8, 1992, now abandoned, which in turn is a continuation application of Ser. No. 07/774,364, filed Oct. 9, 1991, now abandoned, which in turn is a continuation application of Ser. No. 07/655,247, filed Feb. 13, 1991, now abandoned, which in turn is a continuation application of Ser. No. 07/548,199, filed Jul. 5, 1990, now abandoned, which in turn is a continuation application of Ser. No. 07/414,663, filed Sep. 29, 1989, now abandoned, which in turn is a continuation application of Ser. No. 07/201,379, filed May 31, 1988, now abandoned, which in turn is a continuation application of Ser. No. 06/587,936, filed Mar. 9, 1984, now abandoned.

FIELD OF THE INVENTION

This invention relates to catalytic cracking of hydrocarbon feedstocks to produce liquid fuels such as gasoline. More particularly, the present invention relates to an apparatus and process in which the catalytic cracking is achieved at very low residence times.

DESCRIPTION OF THE PRIOR ART

Typically, the process for producing liquid fuels such as gasoline from naturally occurring hydrocarbon feedstocks is achieved by contacting the hydrocarbon feedstock with a catalyst at a high temperature.

The apparatus includes both fluidized bed and riser reactors. In the fluidized bed reactor, the catalyst is retained in a vessel and is fluidized by the hydrocarbons passing through the catalyst. Periodic or continuous regeneration of the catalyst is required, wherein the catalyst is removed from the reactor and heated in a regenerator to provide both heat for the reaction and to remove the coke impurities deposited on the catalyst during the reaction. Residence times for fluidized bed reactors were typically 3 to 5 seconds.

With the advent of more active and selective catalyst, the industry has recently moved to the riser reactor in which the regenerated catalyst and the hydrocarbon feed are delivered to a tubular structure under pressure and passed through the reactor in cocurrent relationship to achieve cracking of the hydrocarbons. Typically, the reactor is a riser in which the catalyst and hydrocarbon feed enter at the bottom of the riser and are transported through the riser. The hot catalyst effects cracking of the hydrocarbon during the passage through the riser and upon discharge from the riser, the cracked products are separated from the catalyst. The catalyst is then delivered to a regenerator where the impurities including coke and poisonous metals are removed by combusting the coke, thereby cleaning the catalyst and at the same time providing the necessary heat for the catalyst in the riser reactor. The riser reactors operate at lower residence time and higher operating temperatures to take full advantage of the better catalyst available currently.

Typically, the cracking reaction proceeds at temperatures from 900° F. to 1100° F. and residence times of 1 seconds or greater. Residence times of 2–3 seconds are not unusual.

It has been suggested, by Gulf Research and Development Company, that high selectivity to gasoline can be realized in riser cracking with low residence times. U.S. Pat. Nos. 3,617,497 and 3,617,512 (Bryson et al; Nov. 2, 1971) discuss the effect of beneficial selectivity to gasoline products at residence times below 5 seconds and particularly below 2 seconds. Lower residence times are suggested particularly for high molecular weight feedstocks which are rich in aromatics.

Recently, the industry has also developed a process in which heavy hydrocarbons such as residual oils can be cracked with catalyst at catalyst temperatures well above the conventional temperatures; i.e., 1400° F. and above. U.S. Pat. Nos. 4,332,674 (Dean et al; Jun. 1, 1982); 4,336,160 (Dean et al; Jun. 22, 1982); 4,331,533 (Dean et al; May 25, 1982) describe a process in which residual oils are catalytically cracked in a riser reactor with catalyst at temperatures up to 1800° F. The residence times employed in the process are typically 0.7 to 1.5 seconds. The higher temperatures permit reduced residence times at equivalent conversions.

SUMMARY OF THE INVENTION

It is an object of the present invention to provide an apparatus and process for catalytically cracking hydrocarbon feedstock at very low residence times.

It is a further object of the present invention to provide an apparatus and process for catalytically cracking heavy hydrocarbon feed under conditions to effect maximum gasoline yield.

The process of the present invention contemplates short residence time contact of solid particles with residual oils or other hydrocarbon feed. The reactor residence times will be in the range of 0.05 to 0.50 second; the temperature in the range of 800° F. to 1200° F.; the pressure from 0 psig to 350 psig. The process of the invention is conducted with thermal regenerative cracking process equipment. The catalytic solids and heavy feed are delivered immediately upstream into the top of a tubular line reactor. The tubular line reactor terminates in a separation zone wherein the product gases are reversed in a 180° path and the solids are passed by gravity to a stripper.

After the solids have been stripped of impurities, the solids are passed in a transport line to the heating receptacle. The carbon on the solids is burned from the solids in either the transport line or the heating receptacle to provide the heat necessary for the transfer line reactor. The flue gas generated by the burning of the coke will contain the sulfur removed from the heavy hydrocarbon, various carbon oxides such as carbon monoxide and carbon dioxide and steam. The sulfur is recovered downstream in conventional sulfur recovery equipment and the carbon monoxide is delivered to heat generation equipment and burned therein as a fuel.

DESCRIPTION OF THE DRAWINGS

The subject invention will be better understood when considered in conjunction with the accompanying drawings wherein.

DESCRIPTION OF THE PREFERRED EMBODIMENT

The process of the subject invention is directed principally to catalytically cracking heavy hydrocarbon feeds to produce commercial hydrocarbon fuels such as gasoline. The feeds contemplated are the residual oils which are heavier and boil at higher temperatures than customary gas oils.

However, the process is suitable for catalytically cracking any heavy hydrocarbon feed that contains sulfur, heavy metal contaminants and coke precursors.

Figure 1:
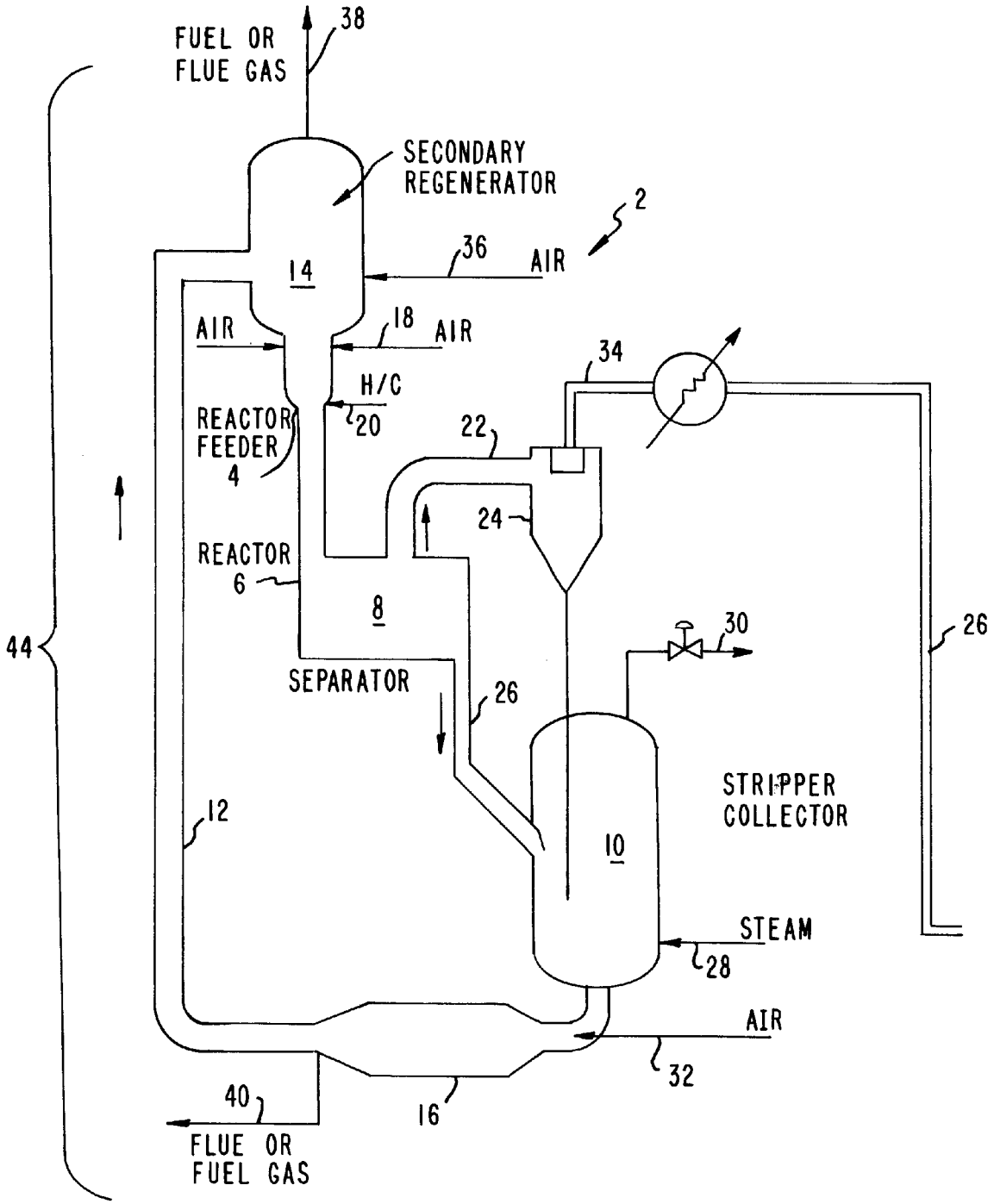
FIG. 1 is a schematic view of the catalytic cracking process and processing system of the subject invention.

As best seen in FIG. 1, the process of the invention is conducted in a thermal regenerative cracking (TRC) system 2, wherein a reactor feeder 4, a tubular reactor 6 and a separator 8 are provided. The system also includes a stripper 10 for the spent catalyst and a regeneration system 44. The spent catalyst regeneration system 44 is comprised of an entrained bed heater 16, a transport line 12 and a secondary regenerator 14.

In the process of the present invention, the heavy hydrocarbon is fed through line 20 to the reactor feeder 4, while cocurrently steam for localized fluidization is delivered through line 18 to facilitate transfer of the regenerated catalyst from the secondary regenerator 14 to the tubular reactor 6. (Shown in detail in FIG. 2). The heavy hydrocarbon feed and particulate regenerated catalyst solids rapidly and intimately mix at the entry of the tubular reactor 6. The catalyst particules enter the tubular reactor 6 at a temperature of 1100° F. to 1800° F., preferably 1300° F. to 1600° F. The pressure in the tubular reactor 6 is 0 to 350 psig. The weight ratio of solids to heavy hydrocarbon feed in the tubular reactor 6 is 3 to 60, preferably 5 to 15. The residence time of the hydrocarbon in the tubular reactor 6 is from 0.05 to 0.50 seconds, preferably 0.1 to 0.2 seconds. The cracking temperature is between 800° F. and 1200° F. and preferably 1000° F. to 1200° F.

The cracked hydrocarbon products and spent catalyst are discharged from the tubular reactor 6 to the separator 8 (shown in detail in FIG. 3) and are immediately separated with the solids from the separator 8 passing through a line 26 to the stripper collector 10.

The reaction products are taken overhead through 22 and delivered to a cyclone separator 24 for removal of entrained solids. The cracked products are taken overhead from the cyclone separator 24 and passed downstream for further processing.

The composition of the cracked gas products is similar to that of a conventional fluidized catalytic cracking unit, but the improvement in selectivity accrues from operations at short residence time. Typically, there is a reduction in coke yield and light gas yield with increase in gasoline, diesel oil and fuel oil products.

The spent solids are stripped of impurities by inert gas, such as steam, entering the stripper-collector 10 through line 28. The steam with impurities is discharged overhead from the stripper-collector through line 30.

The spent solids are regenerated in the solids regeneration system 44. Spent solids pass immediately to an entrained bed heater 16, wherein the carbon on the spent solids is combusted in an oxygen lean environment. The oxygen or air is delivered to the system through line 32. The partially regenerated catalyst passes through a transport line 12 to the secondary regenerator 14, wherein the remaining carbon is combusted in an oxygen rich environment at high temperature. The oxygen or air is delivered to the secondary regenerator through line 36. Flue gas containing essentially carbon dioxide and other incombustibles is taken overhead through line 38.

The gaseous product from the entrained bed heater 16 is discharged through line 40 and passed on for use as a fuel gas within the system. The gas discharged through line 40 is rich in carbon monoxide.

The regenerated catalyst in the secondary regenerator 14 is now at a temperature of 1100° F. to 1800° F., preferably 1300° F. to 1600° F., and is suitable for introduction into the reactor 6 for service as cracking catalyst.

The process of the present invention can rely on the apparatus developed for TRC processing. U.S. Pat. Nos. 4,318,800; 4,370,303; 4,338,187; 4,352,728; 4,390,520; 4,288,235, disclose the TRC process and apparatus and are incorporated herein by reference.

Figure 2:
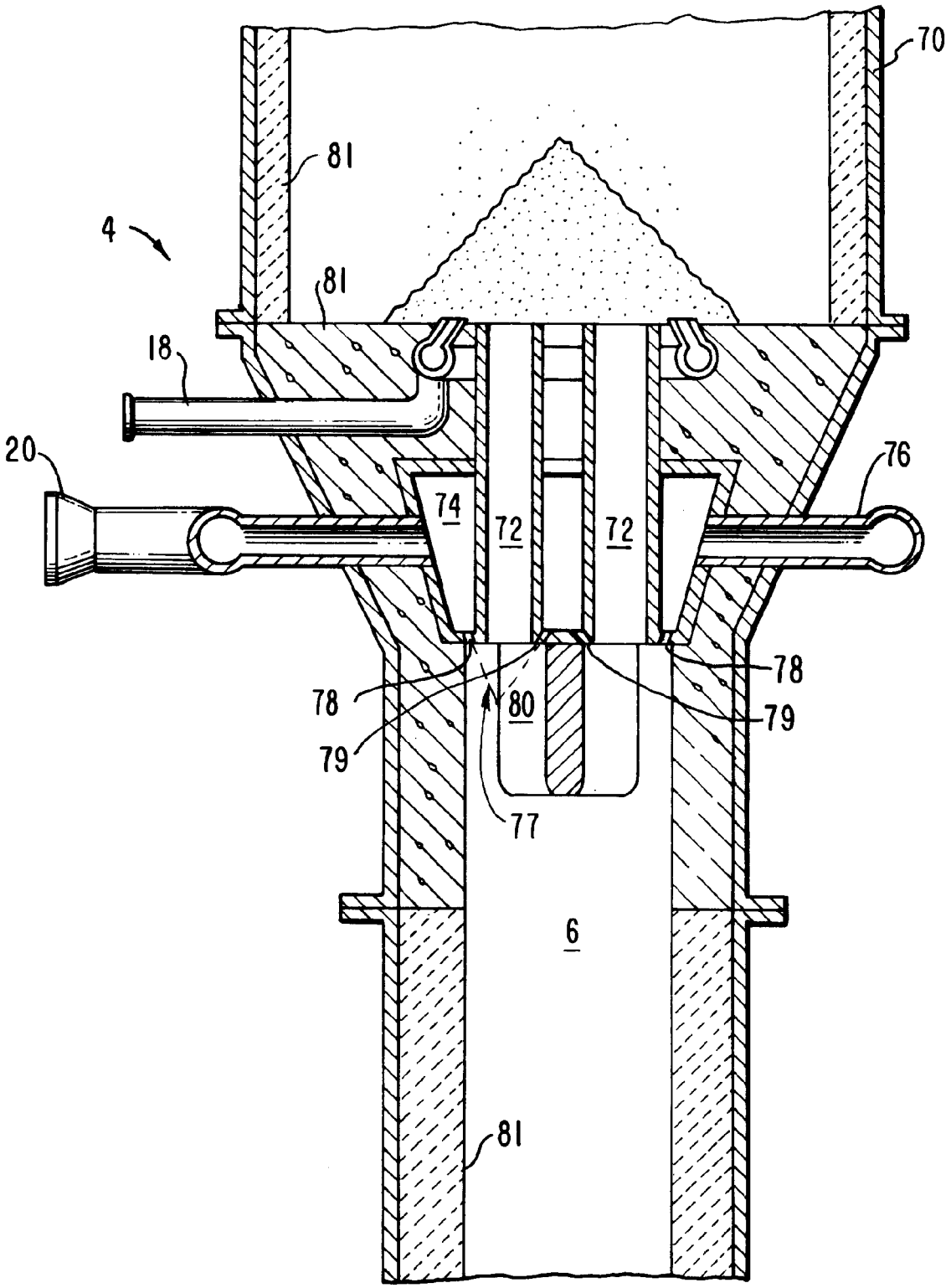
FIG. 2 is a cross-sectional view of the reactor of the subject invention.

The reactor feeder of the TRC processing system is particularly well suited for use in the system due to the capacity to rapidly admix hydrocarbon feed and particulate solids. As seen in FIG. 2, the reactor feeder 4 delivers particulate solids from a solids receptacle 70 through vertically disposed conduits 72 to the reactor 6 and simultaneously delivers hydrocarbon feed to the reactor 6 at an angle into the path of the particulate solids discharging from the conduits 72. An annular chamber 74 to which hydrocarbon is fed by a toroidal feed line 76 terminates in angled openings 78. A mixing baffle or plug 80 also assists in effecting rapid and intimate mixing of the hydrocarbon feed and the particulate solids. The edges 79 of the angled openings 78 are preferably convergently beveled, as are the edges 79 at the reactor end of the conduits 72. In this way, the gaseous stream from the chamber 74 is angularly injected into the mixing zone and intercepts the solids phase flowing from conduits 72. A projection of the gas flow would form a cone shown by dotted lines 77, the vortex of which is beneath the flow path of the solids. By introducing the gas phase angularly, the two phases are mixed rapidly and uniformly, and form a homogeneous reaction phase. The mixing of a solid phase with a gaseous phase is a function of the shear surface between the solids and gas phases, and the flow area. As ratio of shear surface to flow area (S/A) of infinity defines perfect mixing; poorest mixing occurs when the solids are introduced at the wall of the reaction zone. In the system of the present invention, the gas stream is introduced annularly to the solids which ensures high shear surface. By also adding the gas phase transversely through an annular feed means, as in the preferred embodiment, penetration of the phases is obtained and even faster mixing results. By using a plurality of annular gas feed points and a plurality of solid feed conduits, even greater mixing is more rapidly promoted, since the surface to area ratio for a constant solids flow area is increased. Mixing is also a known function of the L/D of the mixing zone. A plug creates an effectively reduced diameter D in a constant L, thus increasing mixing.

The plug 80 reduces the flow area and forms discrete mixing zones. The combination of annular gas addition around each solids feed point and a confined discrete mixing zone greatly enhances the conditions for mixing. Using this preferred embodiment, the time required to obtain an essentially homogenous reaction phase in the reaction zone is quite low. Thus, this preferred method of gas and solids addition can be used in reaction systems having a residence time below 1 second, and even below 100 milliseconds.

Because of the environment of the reactor 6 and reactor feeder 4, the walls are lined with an inner core 81 of ceramic material. The detail of the reactor feeder is more fully described in U.S. Pat. No. 4,388,187, which is incorporated herein by reference.

Figure 3:
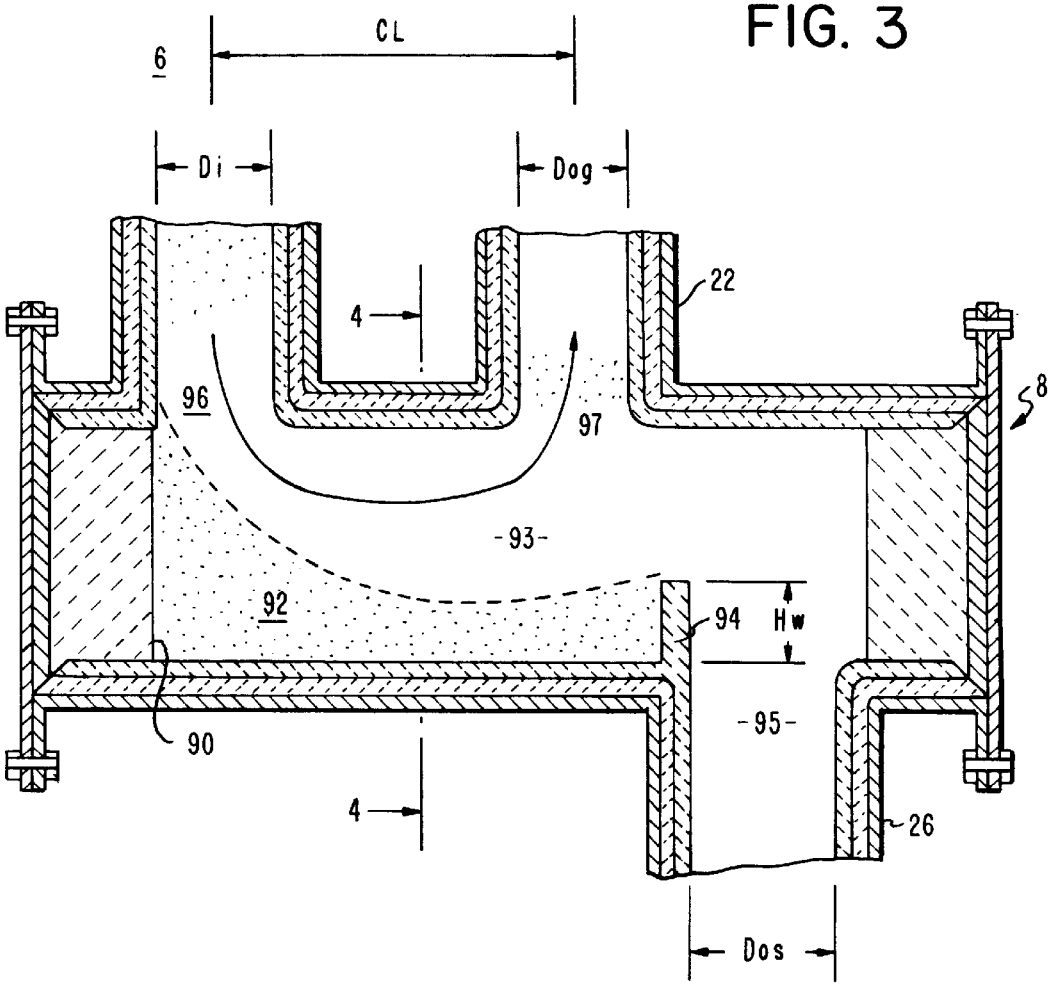
FIG. 3 is a cross-sectional view of the separator of the present invention.

The separator 8 of the TRC system seen in FIG. 3, can also be relied on for rapid and discrete separation of cracked product and particulate solids discharging from the reactor 6. The inlet to the separator 8 is directly above a right angle corner 90 at which a mass of particulate solids 92 collect. A weir 94 downstream from the corner 90 facilitates accumulation of the mass of solids 92. The gas outlet 22 of the separator 8 is oriented 180° from the separator gas-solids inlet 96 and the solids outlet 26 is directly opposed in orientation to the gas outlet 22 and down-stream of both the gas outlet 22 and the weir 94. In operation, centrifugal force propels the solid particles to the wall opposite inlet 96 of the chamber 93 while the gas portion having less momentum, flows through the vapor space of the chamber 93. Initially, solids impinge on the wall opposite the inlet 96 but subsequently accumulate to form a static bed of solids 92 which ultimately form in a surface configuration having a curvilinear arc of approximately 90° of a circle. Solids impinging upon the bed 92 are moved along the curvilinear arc to the solids outlet 95, which is preferably oriented for downflow of solids by gravity. The exact shape of the arc is determined by the geometry of the particular separator and the inlet stream parameters such as velocity, mass flowrate, bulk density, and particle size. Because the force imparted to the incoming solids is directed against the static bed 92 rather than the separator 8 itself, erosion is minimal. Separator efficiency, defined as the removal of solids from the gas phase leaving through outlet 97 is, therefore, not affected adversely by high inlet velocities, up to 150 ft./sec., and the separator 8 is operable over a wide range of dilute phase densities, preferably between 0.1 and 10.0 lbs./ft$^3$. The separator 8 of the present invention achieves efficiencies of about 80%, although the preferred embodiment, can obtain over 90% removal of solids.

It has been found that separator efficiency is dependent upon separator geometry, and more particularly, the flow path must be essentially rectangular, and there is an optimum relationship between the height H and the sharpness of the U-bend in the gas flow.

It has been found that for a given height H of chamber 93, efficiency increases as the 180° U-bend between inlet 96 and outlet 97 is brought progressively closer to inlet 96. Thus, for a given H the efficiency of the separator increases as the flow path decreases and, hence, residence time decreases. Assuming an inside diameter $D_i$ of inlet 96, the preferred distance CL between the centerlines of inlet 96 and outlet 97 is not greater than 4.0 $D_i$, while the most preferred distance between said centerlines is between 1.5 and 2.5 $D_i$. Below 1.5 $D_i$ better separation is obtained but difficulty in fabrication makes this embodiment less attractive in most instances. Should this latter embodiment be desired, the separator 8 would probably require a unitary casting design because inlet 96 and outlet 97 would be too close to one another to allow welded fabrication.

It has been found that the height of flow path H should be at least equal to the value of $D_i$ or 4 inches in height, whichever is greater. Practice teaches that if H is less than $D_i$ or 4 inches the incoming stream is apt to disturb the bed solids 92 thereby re-entraining solids in the gas product leaving through outlet 97. Preferably H is on the order of twice $D_i$ to obtain even greater separation efficiency. While not otherwise limited, it is apparent that too large an H eventually merely increases residence time without substantive increases in efficiency. The width W of the flow path is preferably between 0.75 and 1.25 times $D_i$ most preferably between 0.9 and 1.10 $D_i$.

Outlet 97 may be of any inside diameter. However, velocities greater than 75 ft./sec. can cause erosion because of residual solids entrained in the gas. The inside diameter of outlet 97 should be sized so that a pressure differential between the stripping vessel 10 shown in FIG. 1 and the separator 8 exist such that a static height of solids is formed in solids outlet line 26. The static height of solids in line 26 forms a positive seal which prevents gases from entering the stripping vessel 10. The magnitude of the pressure differential between the stripping vessel 10 and the separator 8 is determined by the force required to move the solids in bulk flow to the solids outlet 95 as well as the height of solids in line 26. As the differential increases the net flow of gas to the stripping vessel 10 decreases. Solids, having gravitational momentum, overcome the differential, while gas preferentially leaves through the gas outlet.

Figure 4:
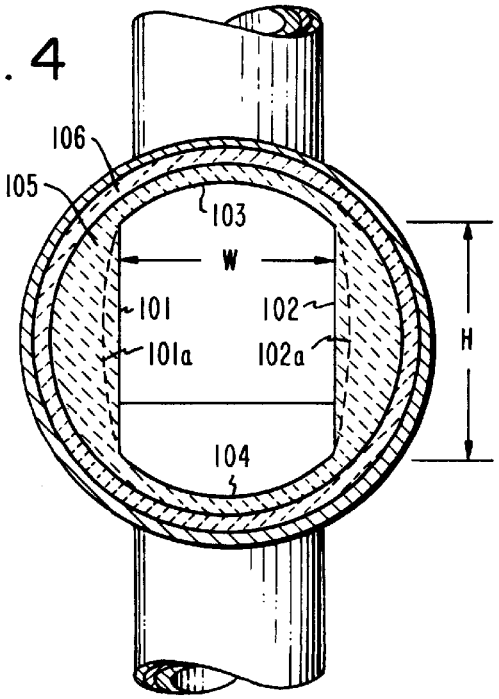
FIG. 4 is a sectional view through line 4—4 of FIG. 3.

FIG. 4 shows a cutaway view of a the separator along section 4—4 of FIG. 3. It is essential that longitudinal side walls 101 and 102 should be rectilinear, or slightly arcuate as indicated by the dotted lines 101*a* and 102*a*. Thus, the flow path through the separator 8 is essentially rectangular in cross section having a height H and width W as shown in FIG. 4. The embodiment shown in FIG. 4 defines the geometry of the flow path by adjustment of the lining width for walls 101 and 102. Alternatively, baffles, inserts, weirs or other means may be used. In like fashion the configuration of walls 103 and 104 transverse to the flow path may be similarly shaped, although this is not essential.

The separator shell and manways are preferably lined with erosion resistent linings 105, which may be required if solids at high velocities are encountered. Typical commercially available materials for erosion resistent lining include Carborundum Precast Carbofrax D, Carborundum Precast Alfrax 201 or their equivalent. A thermal insulation lining 106 may be placed between the shell and the lining 105 and between the manways and their respective erosion resistent linings when the separator is to be used in high temperatures service. Thus, process temperatures above 1500° F. (870° C.) can be used.

The detail of the separator 8 is more fully described in U.S. Pat. No. 4,288,235 which is incorporated herein by reference.

An illustration of the process of the present invention reveals the benefit of catalytically cracking hydrocarbon with the process of the present invention.

If an Arabian Atmospheric Tower Bottoms (ATB) hydrocarbon feed is fed through line 20 to the reactor 6 and cracked under the following conditions:

Reactor Temperature—1050° F.
Residence Time—0.20 seconds
Regenerated Catalyst
Temperature—1350° F.
Catalyst to Feed
Weight Ratio—9
Pressure—20 psig
Temperature of
Feed to Reactor—500° F.

The yield of the process of the present invention compared to the same feed processed conventionally at a reaction temperature of 950° F., residence time of 2.0 seconds, regeneration temperature of 1300° F., catalyst to feed weight ratio of 8 and a feed to reactor temperature of 200° F. would be as follows:

| | Present Invention | Conventional |
|---|---|---|
| $C_2$ and lighter | 1.7 | 3.5 |
| $C_4$ , gasoline | 49.8 | 44.6 |
| HCO (heavy cycle oil) | 5.7 | 8.7 |
| Coke | 6.7 | 13.3 |
| Conversion Vol. % | 85% | 77% |

We claim:

1. A process for catalytically cracking a heavy hydrocarbon feed with catalytic solid particles to selectively produce gasoline comprising:

(a) delivering the heavy hydrocarbon feedstock to a tubular reactor at the entrance of the tubular reactor;

(b) delivering all of the catalytic solid particles comprising a zeolite component in combination with an alumina matrix to the tubular reactor at the entrance of the tubular reactor; and (c) catalytically cracking the heavy hydrocarbon feedstock at a temperature between 800° F. and 1200° F. for a residence time of from 0.05 to 0.50 seconds at a catalytic solid particles to feedstock weight ratio of from 3 to 15.

2. A process as defined in claim 1 wherein the catalytic cracking conditions further comprise a pressure between 0 and 350 psig.

3. A process as defined in claim 1 wherein said cracking conditions comprise a cracking temperature of from 800° F. to 1050° F.

4. A process as defined in claim 1 wherein said cracking conditions comprise a cracking temperature of from 900° to 1100° F.

5. A process as defined in claim 1 wherein said residence time ranges from 0.1 to 0.4 seconds.

6. A process as defined in claim 1 wherein the cracking conditions further comprise a pressure of about 20 psig, a catalyst to hydrocarbon feed weight ratio of about 8, a hydrocarbon feed temperature of about 500° F. and a catalyst delivery temperature of about 1350° F.

7. A process as defined in claim 1 wherein said tubular reactor is either an upflow riser or downflow riser reactor.

8. A process as defined in claim 7 wherein said tubular reactor is an upflow riser reactor.

9. A process as defined in claim 7 wherein said tubular reactor is a downflow riser reactor.

10. A process as defined in claim 1 wherein the the heavy hydrocarbon feedstock and the catalytic solid particles form a homogeneous reaction phase in said tubular reactor.

11. A process as defined in claim 1 further comprising the step of separating the cracked product gases and particulate catalyst solids.

12. A process as defined in claim 11 further comprising the step of quenching the separated cracked product gases.

13. A process as defined in claim 1 having a catalyst to oil weight ratio of from 5 to 15.

14. A process for catalytically cracking a heavy hydrocarbon feed with catalytic solid particles to selectively produce gasoline comprising:

(a) delivering the heavy hydrocarbon feed to the entrance of a riser reactor;

(b) delivering all of the particulate catalyst solids comprising a zeolite component in combination with an alumina matrix to the entrance of the riser reactor at a temperature of from about 1300° to about 1600° F. and a particulate catalyst solids to hydrocarbon feed weight ratio between 3 and 15;

(c) cracking the heavy hydrocarbon to cracked product gases at a temperature between 800° F. and 1050° F., a pressure between 0 and 350 psig and at a heavy hydrocarbon residence time of from 0.05 to 0.5 seconds; and (d) separating the cracked product gases and particulate catalyst solids in a separator;

whereby the selectivity to gasoline is improved over a process operating at a higher residence time and constant conversion.

15. A process for catalytically cracking a heavy hydrocarbon feed with particulate catalyst solids to selectively produce gasoline comprising:

(a) delivering the heavy hydrocarbon feed to the entrance of an upflow riser reactor;

(b) delivering all of the particulate catalyst solids comprising a zeolite component in combination with an alumina matrix to the entrance of the riser reactor at a temperature of from about 1300° to about 1600° F. and a particulate catalyst solids to hydrocarbon feed weight ratio between 3 and 15;

(c) cracking the heavy hydrocarbon to cracked product gases at a temperature between 800° F. and 1000° F., a pressure between 0 and 350 psig and at a heavy hydrocarbon residence time of from 0.05 to 0.5 seconds; and (d) separating the cracked product gases and particulate catalyst solids in a separator;

whereby the selectivity to gasoline is improved over a process operating at a higher residence time and constant conversion.

16. A process for catalytically cracking a heavy hydrocarbon feed with particulate catalyst solids to selectively produce gasoline comprising:

(a) delivering a heavy hydrocarbon feed to the top of a downflow riser reactor;

(b) delivering all of the particulate catalyst solids comprising a zeolite component in combination with an alumina matrix to the top of the downf low riser reactor at a temperature of from about 1300° to about 1600° F. and a particulate catalyst solids to hydrocarbon feed weight ratio between 3 and 15;

(c) cracking the heavy hydrocarbon to cracked product gases at a temperature between 800° F. and 1050° F., a pressure between 0 and 350 psig and at a heavy hydrocarbon residence time of from 0.05 to 0.5 seconds; and (d) separating the cracked product gases and particulate catalyst solids in a separator;

whereby the selectivity to gasoline is improved over a process operating at a higher residence time and constant conversion.

17. A process for catalytically cracking a heavy hydrocarbon feed with particulate catalyst solids to selectively produce gasoline comprising:

(a) delivering the heavy hydrocarbon feed to the top of a downflow riser reactor;

(b) delivering all of the particulate catalyst solids comprising a zeolite component in combination with an alumina matrix to the top of the downflow riser reactor at a temperature of from about 1300° to about 1600° F. and a particulate catalyst solids to hydrocarbon feed weight ratio between 3 and 15;

(c) cracking the heavy hydrocarbon to cracked product gases at a temperature between 800° F. and 1000° F., a pressure between 0 and 350 psig and at a heavy hydrocarbon residence time of from 0.05 to 0.5 seconds; and (d) separating the cracked product gases and particulate catalyst solids in a separator;

whereby the selectivity to gasoline is improved over a process operating at a higher residence time and constant conversion.

18. A process for catalytically cracking a heavy hydrocarbon feedstock with catalytic solid particles to selectively produce gasoline comprising:

(a) delivering the heavy hydrocarbon feedstock to the entrance of a tubular reactor;

(b) delivering all of the catalytic solid particles comprising a zeolite component in combination with an alumina matrix to the entrance of the tubular reactor; and (c) catalytically cracking the heavy hydrocarbon feedstock at a temperature between 800° and 1100° F. for a residence time of from 0.05 to 0.2 seconds and a particulate catalyst solids to hydrocarbon feed weight ratio between 3 and 60.

* * * * *